US008469292B1

(12) United States Patent
Hanson et al.

(10) Patent No.: US 8,469,292 B1
(45) Date of Patent: Jun. 25, 2013

(54) SPRAY TEXTURE MATERIAL COMPOSITIONS AND DISPENSING SYSTEMS AND METHODS

(75) Inventors: Randal W. Hanson, Bellingham, WA (US); John Kordosh, Simi Valley, CA (US)

(73) Assignee: Homax Products, Inc., Bellingham, WA (US)

( * ) Notice: Subject to any disclaimer, the term of this patent is extended or adjusted under 35 U.S.C. 154(b) by 66 days.

(21) Appl. No.: 13/113,816

(22) Filed: May 23, 2011

Related U.S. Application Data

(63) Continuation of application No. 12/080,097, filed on Mar. 31, 2008, now abandoned.

(60) Provisional application No. 60/922,040, filed on Apr. 4, 2007.

(51) Int. Cl.
*A62C 11/00* (2006.01)

(52) U.S. Cl.
USPC ..... 239/359; 239/337

(58) Field of Classification Search
USPC ..... 239/11, 546, 547, 578, 579, 581.1, 239/581.2, 525, 526, 602, DIG. 12, 323
See application file for complete search history.

(56) References Cited

U.S. PATENT DOCUMENTS

| | | | | |
|---|---|---|---|---|
| 604,151 | A | 5/1898 | Horn | |
| 625,594 | A | 5/1899 | Oldham | |
| 1,770,011 | A | 7/1930 | Poston | |
| 1,809,073 | A | 6/1931 | Schylander | |
| 1,988,017 | A | 1/1935 | Norwick | |
| 2,305,239 | A | 12/1942 | Moreland | |
| 2,887,274 | A | 5/1959 | Swenson | |
| 2,923,481 | A | 2/1960 | Pinke | |
| 3,027,096 | A * | 3/1962 | Giordano | 239/304 |
| 3,390,121 | A | 6/1968 | Burford | |

(Continued)

FOREIGN PATENT DOCUMENTS

| | | |
|---|---|---|
| CA | 1210371 | 8/1986 |
| CA | 2090185 | 8/1993 |

(Continued)

OTHER PUBLICATIONS

Chinese document disclosing a trigger spray assembly for a spray bottle; Jun. 5, 2004; 1 page.

(Continued)

*Primary Examiner* — Davis Hwu
(74) *Attorney, Agent, or Firm* — Michael R. Schacht; Schacht Law Offices, Inc.

(57) ABSTRACT

A system for coating a target surface comprises texture material, a bottle for containing the texture material, a spray pump assembly, a resilient member, and a collar member. The spray pump assembly comprises a pump housing operatively connected to the bottle, a dip tube extending from the pump housing to the texture material within the bottle, and an actuator member. The resilient member is supported by the pump housing to define an outlet opening. The collar member is supported by the pump housing such that the collar member is movable relative to the resilient member. Moving the collar member relative to the resilient member deforms the resilient member to alter a cross-sectional area of the outlet opening. The actuator member is displaced to force the texture material through the dip tube, out of the bottle member, through the outlet opening, and onto the target surface.

11 Claims, 3 Drawing Sheets

U.S. PATENT DOCUMENTS

| | | | | | |
|---|---|---|---|---|---|
| 3,498,541 | A | * | 3/1970 | Johnston et al. | 239/708 |
| 3,773,706 | A | | 11/1973 | Dunn, Jr. | |
| 3,788,526 | A | | 1/1974 | Thornton et al. | |
| 3,848,808 | A | * | 11/1974 | Fetty et al. | 239/327 |
| 3,975,554 | A | | 8/1976 | Kummins et al. | |
| 4,164,492 | A | | 8/1979 | Cooper | |
| 4,195,780 | A | | 4/1980 | Inglis | |
| 4,204,645 | A | | 5/1980 | Hopp | |
| 4,232,828 | A | * | 11/1980 | Shelly, Jr. | 239/329 |
| 4,411,387 | A | | 10/1983 | Stern et al. | |
| 4,460,719 | A | | 7/1984 | Danville | |
| 4,706,888 | A | | 11/1987 | Dobbs | |
| RE33,235 | E | | 6/1990 | Corsette | |
| 4,954,544 | A | | 9/1990 | Chandaria | |
| 4,955,545 | A | | 9/1990 | Stern et al. | |
| 4,961,537 | A | | 10/1990 | Stern | |
| 5,037,011 | A | | 8/1991 | Woods | |
| 5,039,017 | A | | 8/1991 | Howe | |
| 5,069,390 | A | | 12/1991 | Stern et al. | |
| 5,188,263 | A | | 2/1993 | Woods | |
| 5,188,295 | A | | 2/1993 | Stern et al. | |
| 5,310,095 | A | | 5/1994 | Stern et al. | |
| 5,341,970 | A | | 8/1994 | Woods | |
| 5,360,127 | A | | 11/1994 | Barriac et al. | |
| 5,409,148 | A | | 4/1995 | Stern et al. | |
| D358,989 | S | | 6/1995 | Woods | |
| 5,421,519 | A | | 6/1995 | Woods | |
| 5,425,824 | A | | 6/1995 | Marwick | |
| 5,450,983 | A | | 9/1995 | Stern et al. | |
| 5,476,879 | A | | 12/1995 | Woods et al. | |
| 5,489,048 | A | | 2/1996 | Stern et al. | |
| 5,498,282 | A | | 3/1996 | Miller et al. | |
| 5,505,344 | A | | 4/1996 | Woods | |
| 5,524,798 | A | | 6/1996 | Stern et al. | |
| 5,548,010 | A | | 8/1996 | Franer | |
| 5,583,178 | A | | 12/1996 | Oxman et al. | |
| 5,639,026 | A | | 6/1997 | Woods | |
| 5,645,198 | A | | 7/1997 | Stern et al. | |
| 5,655,691 | A | | 8/1997 | Stern et al. | |
| 5,715,975 | A | | 2/1998 | Stern et al. | |
| 5,727,736 | A | | 3/1998 | Tryon | |
| D409,487 | S | | 5/1999 | Wadsworth et al. | |
| D409,917 | S | | 5/1999 | Wadsworth et al. | |
| D409,918 | S | | 5/1999 | Wadsworth et al. | |
| 5,921,446 | A | | 7/1999 | Stern | |
| 5,934,518 | A | | 8/1999 | Stern et al. | |
| 5,941,462 | A | | 8/1999 | Sandor | |
| 6,000,583 | A | | 12/1999 | Stern et al. | |
| 6,095,377 | A | | 8/2000 | Sweeton et al. | |
| 6,095,435 | A | | 8/2000 | Greer, Jr. et al. | |
| 6,112,945 | A | | 9/2000 | Woods | |
| 6,116,473 | A | | 9/2000 | Stern et al. | |
| 6,126,090 | A | | 10/2000 | Wadsworth et al. | |
| 6,131,820 | A | | 10/2000 | Dodd | |
| 6,152,335 | A | | 11/2000 | Stern et al. | |
| 6,168,093 | B1 | | 1/2001 | Greer, Jr. et al. | |
| D438,111 | S | | 2/2001 | Woods | |
| 6,225,393 | B1 | | 5/2001 | Woods | |
| 6,227,411 | B1 | | 5/2001 | Good | |
| 6,261,631 | B1 | | 7/2001 | Lomasney et al. | |
| 6,265,459 | B1 | | 7/2001 | Mahoney et al. | |
| 6,276,570 | B1 | | 8/2001 | Stern et al. | |
| 6,299,686 | B1 | | 10/2001 | Mills | |
| 6,328,185 | B1 | | 12/2001 | Stern et al. | |
| 6,352,184 | B1 | | 3/2002 | Stern et al. | |
| 6,375,036 | B1 | | 4/2002 | Woods | |
| 6,382,474 | B1 | | 5/2002 | Woods et al. | |
| 6,386,402 | B1 | | 5/2002 | Woods | |
| 6,399,687 | B2 | | 6/2002 | Woods | |
| 6,415,964 | B2 | | 7/2002 | Woods | |
| 6,446,842 | B2 | | 9/2002 | Stern et al. | |
| D468,980 | S | | 1/2003 | Woods | |
| 6,531,528 | B1 | | 3/2003 | Kurp | |
| 6,536,633 | B2 | | 3/2003 | Stern et al. | |
| 6,641,005 | B1 | | 11/2003 | Stern et al. | |
| 6,641,864 | B2 | | 11/2003 | Woods | |
| 6,659,312 | B1 | | 12/2003 | Stern et al. | |
| 6,666,352 | B1 | | 12/2003 | Woods | |
| 6,712,238 | B1 | | 3/2004 | Mills | |
| 6,726,066 | B2 | | 4/2004 | Woods | |
| 6,797,051 | B2 | | 9/2004 | Woods | |
| 6,848,601 | B2 | | 2/2005 | Greer, Jr. | |
| 6,883,688 | B1 | | 4/2005 | Stern et al. | |
| 6,894,095 | B2 | | 5/2005 | Russo et al. | |
| 6,905,050 | B1 | | 6/2005 | Stern et al. | |
| 6,910,608 | B2 | | 6/2005 | Greer, Jr. et al. | |
| 6,913,407 | B2 | | 7/2005 | Greer et al. | |
| 7,014,073 | B1 | | 3/2006 | Stern et al. | |
| 7,059,497 | B2 | | 6/2006 | Woods | |
| 7,063,236 | B2 | | 6/2006 | Greer, Jr. et al. | |
| 7,163,962 | B2 | | 1/2007 | Woods | |
| 7,189,022 | B1 | | 3/2007 | Greer, Jr. et al. | |
| 7,192,985 | B2 | | 3/2007 | Woods | |
| 2001/0002676 | A1 | | 6/2001 | Woods | |
| 2002/0119256 | A1 | | 8/2002 | Woods | |
| 2004/0012622 | A1 | | 1/2004 | Russo et al. | |
| 2004/0099697 | A1 | | 5/2004 | Woods | |
| 2004/0195277 | A1 | | 10/2004 | Woods | |
| 2005/0161531 | A1 | | 7/2005 | Greer et al. | |
| 2005/0236436 | A1 | | 10/2005 | Woods | |
| 2006/0079588 | A1 | | 4/2006 | Greer, Jr. | |
| 2006/0180616 | A1 | | 8/2006 | Woods | |
| 2006/0219808 | A1 | | 10/2006 | Woods | |
| 2006/0219811 | A1 | | 10/2006 | Woods | |
| 2006/0273207 | A1 | | 12/2006 | Woods | |

FOREIGN PATENT DOCUMENTS

| | | |
|---|---|---|
| CA | 2145129 | 9/1995 |
| CA | 2291599 | 6/2000 |
| CA | 2381994 | 2/2001 |
| CA | 2327903 | 6/2001 |
| CA | 2065534 | 8/2003 |
| CA | 2448794 | 5/2004 |
| CA | 2504509 | 10/2005 |
| CA | 2504513 | 10/2005 |
| DE | 250831 | 9/1912 |
| GB | 2418959 | 12/2006 |

OTHER PUBLICATIONS

Chinese document disclosing a trigger spray assembly for a spray bottle; Jun. 4, 2004; 1 page.

Chinese document disclosing a trigger spray assembly for a spray bottle; 1 page.

Saint-Gobain Calmar; "Mixor HP Trigger Sprayer Brochure", Dec. 2001; 2 pages.

Homax Products, Inc., "Easy Touch Spray Texture Brochure", Mar. 1992, 1 page.

* cited by examiner

SPRAY TEXTURE MATERIAL COMPOSITIONS AND DISPENSING SYSTEMS AND METHODS

RELATED APPLICATIONS

This application U.S. application Ser. No. 13/113,816 filed May 23, 2011, is a continuation of U.S. patent application Ser. No. 12/080,097, filed Mar. 31, 2008, now abandoned.

U.S. patent application Ser. No. 12/080,097 claims benefit of U.S. Provisional Application Ser. No. 60/922,040 filed Apr. 4, 2007.

The contents of all applications from which the present application claims priority are incorporated herein by reference.

TECHNICAL FIELD

The present invention relates to systems and methods for applying texture materials to a target surface and, more specifically, to compositions of texture materials and dispensing systems and methods for dispensing texture material in small quantities.

BACKGROUND

The surfaces of drywall materials defining wall and ceiling surfaces are commonly coated with texture materials. Texture materials are coatings that are deposited in discrete drops that dry to form a bumpy, irregular texture on the destination surface. Texture materials are commonly applied using a hopper gun connected to a source of pressurized air. However, when only a small are is to be coated or an existing textured surface is repaired, texture materials are typically applied using an aerosol dispensing system.

An aerosol dispensing system for dispensing texture material typically comprises a container assembly, a valve assembly, and an outlet assembly. The container assembly contains the texture material and a propellant material. The propellant material pressurizes the texture material within the container assembly. The valve assembly is mounted to the container assembly in a normally closed configuration but can be placed in an open configuration to define a dispensing path along which the pressurized texture material is forced out of the container assembly by the propellant material. Displacement of the outlet assembly places the valve assembly in the open configuration. The outlet assembly defines a portion of the outlet path and is configured such that the texture material is applied to the destination surface in an applied texture pattern.

The need exists for alternatives to aerosol systems for dispensing of texture materials.

SUMMARY

The present invention may be embodied as a system for coating a target surface in a desired texture pattern that substantially matches a preexisting texture pattern on the target surface comprises texture material, a bottle for containing the texture material, a spray pump assembly, a resilient member, and a collar member. The spray pump assembly comprises a pump housing operatively connected to the bottle, a dip tube extending from the pump housing to the texture material within the bottle, and an actuator member. The resilient member is supported by the pump housing to define an outlet opening. The collar member is supported by the pump housing such that the collar member is movable relative to the resilient member. Moving the collar member relative to the resilient member deforms the resilient member to alter a cross-sectional area of the outlet opening such that the cross-sectional area of the outlet opening is associated with the desired spray pattern. Displacing the actuator member forces the texture material through the dip tube, out of the bottle member, through the outlet opening, and onto the target surface such that the texture material dries to form a coating in the desired texture pattern.

The present invention may also be embodied as a system for coating a target surface in a desired texture pattern that substantially matches a preexisting texture pattern on the target surface comprising texture material, a bottle for containing the texture material, a spray pump assembly, an a collar member. The spray pump assembly comprises a pump housing operatively connected to the bottle, a dip tube extending from the pump housing to the texture material within the bottle, and an actuator member. The spray assembly is operatively connected to the bottle and defines an outlet member. The collar member is supported by the outlet member and defines a plurality of outlet openings. The outlet is moved relative to the pump spray assembly to define a selected outlet opening from the plurality of outlet openings. Displacing the actuator member forces the texture material through the dip tube, out of the bottle member, and through the selected outlet opening and onto the target surface.

The present invention may also be embodied as a method of coating a target surface in a desired texture pattern that substantially matches a preexisting texture pattern on the target surface comprising the following steps. Texture material is arranged within a bottle. A spray pump assembly comprising a pump housing, a dip tube, and an actuator member is provided. The spray pump assembly is operatively connected to to the bottle such that the dip tube extends into the texture material. A resilient member is supported relative to the bottle to define an outlet opening. A collar member is supported such that the collar member is movable relative to the resilient member. The collar member is moved relative to the resilient member to deform the resilient member to alter a cross-sectional area of the outlet opening such that the cross-sectional area of the outlet opening is associated with a spray pattern associated with the desired texture pattern. The actuator member is displaced to cause pressurized air to flow through the spray pump assembly such that the pressurized air forces the texture material through the dip tube, out of the bottle member, through the outlet opening, and onto the target surface such that the texture material dries to form a coating in the desired texture pattern.

DETAILED DESCRIPTION

Figure 1A:
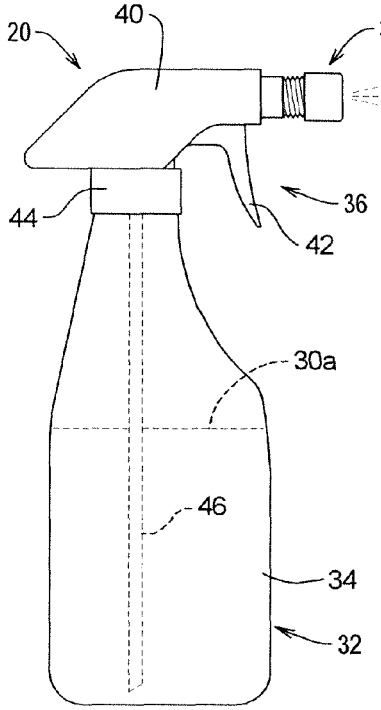
FIG. 1A is a side elevation view depicting a first example hand-operated dispensing system of the present invention being used to apply texture material to a target surface.

Referring initially to FIGS. 1-7 of the drawing, depicted therein is a hand-operated dispensing system 20 for dispensing texture materials. As perhaps best shown in FIGS. 1A and 1B, the dispensing system 20 is adapted to dispense texture material onto a target surface portion 22 of a wall structure 24. A main surface portion 26 of the wall structure 24 is coated with existing coating material 28. In the example depicted in FIGS. 1A, the target surface portion 22 has been repaired, so the existing surface coating material 28 is not present at the target surface portion 22.

While the present invention is of particular significance in the context of repairing a target surface portion such as the example target surface portion 22, the present invention can be used in other situations. For example, dispensing system 20 can be used to apply texture material to a bare wall surface, or the dispensing system 20 can be used to apply texture material of a second color on top of an existing coating material of a first color.

The dispensing system 20 dispenses texture material 30. The dispensing system 20 comprises a bottle assembly 32 comprising a bottle member 34, a spray pump assembly 36, and an outlet assembly 38. The example spray pump assembly 36 is or may be conventional and comprises a pump housing 40, pump actuator 42, pump sleeve 44, and dip tube 46. The pump sleeve 44 secures the pump housing 40 to the bottle member 34, and movement of the actuator member 42 forces the liquid texture material out of the bottle assembly 32 through the dip tube 46 and the outlet assembly 38.

Figure 1B:
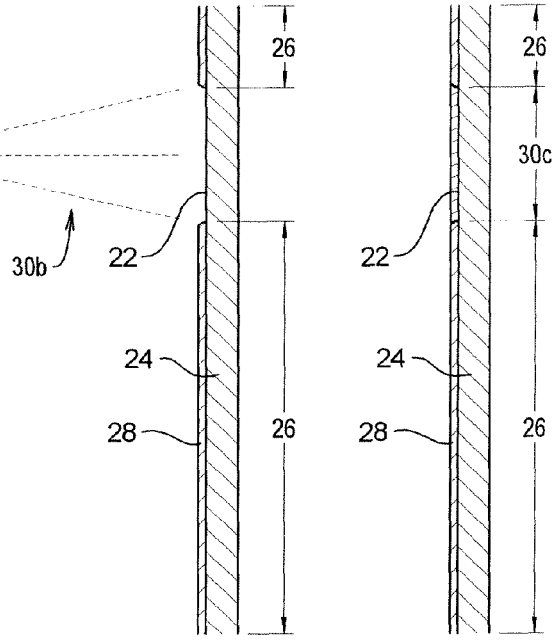
FIG. 1B is a side elevation view depicting the target surface with texture material applied thereto.

The construction of the dispensing system 20 and formulation of the texture material 30 are such that the dry texture material 30*c* defines a bumpy, variegated surface pattern that substantially matches an existing surface pattern defined by the existing surface coating material 28. In particular, the texture material 30 is stored within the bottle assembly in a liquid form 30*a* and is dispensed by the pump assembly 36 through the outlet assembly 38 in a spray form 30*b*. FIGS. 1A and 1B show that the spray of texture material 30*b* is deposited onto the target surface portion 22, where it dries to form a dry texture material 30*c*.

The outlet assembly 38 is configured to allow a user of the dispensing system 20 generally to control the size of droplets forming the spray form 30*b* of the texture pattern. The size of these droplets in turn determines the height of the projections and depth of the valleys that determine the texture pattern defined by the dry texture material 30*c*.

Figure 2:
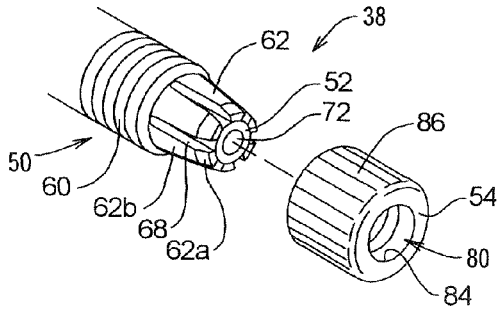
FIG. 2 is an exploded view of a first example outlet assembly that may be used by the example dispensing systems described herein.

Referring now more specifically to FIG. 2 of the drawing, the first example outlet assembly 38 will be described in further detail. The first example outlet assembly 38 comprises an outlet member 50, a resilient member 52, and a collar member 54. The outlet member 50 may be secured relative to, rigidly connected to, or integrally formed with the pump housing 40; the example outlet member 50 is integrally formed with the pump housing 40.

The outlet member 50 defines a first threaded portion 60, a plurality (two or more) of finger portions 62 defining distal and proximal cam surfaces 62*a* and 62*b*, and a dispensing passageway 64 along which the liquid texture material 30*a* is forced out of the bottle assembly 32. The outlet member 50 defines a socket portion 66 within the dispensing passageway 64. A finger slit 68 is formed between each adjacent pair of finger portions 62. The outlet member 50 is made of a resilient material such that the finger portions 62 can be displaced relative to the first threaded portion 60.

The example resilient member 52 is a hollow tube formed of deformable material that defines an outlet passageway 70 and an outlet opening 72. The resilient member 52 is configured to engage the socket portion 66 such that the resilient member 52 is supported at least partly within the dispensing passageway 64 and at least partly between the finger portions 62.

A dispensing axis 74 extends along the outlet passageway 70. Texture material forced out of the bottle assembly 32 travels along the dispensing axis 74 through the dispensing passageway 64 and the outlet opening 72.

The collar member 54 defines a collar passageway 80, a second threaded portion 82, a cam ring portion 84, and a grip surface 86. The collar member 54 is displaced relative to the outlet member 50 such that finger portions 62 of the outlet member 50 enter the collar passageway 80. Continued displacement of the collar member 54 causes the first and second threaded portions 60 and 82 to touch each other. At that point, the grip surface 86 may be gripped to rotate the collar member 54 relative to the outlet member 50 to cause the threaded portions 60 and 82 to engage each other such that the collar member 54 moves along the dispensing axis 74 relative to the outlet member 50.

As the collar member 54 moves along the dispensing axis 74 relative to the outlet member 50, the cam ring portion 84 of the collar member 54 engages the distal cam surfaces 62*a* on the finger portions 62. Continued rotation of the collar member 54 relative to the outlet member 50 causes the finger portions 62 to move radially inwardly towards the dispensing axis A. As these finger portions 62 move radially inwardly, they deform the resilient member 52 to alter a cross-sectional area of the outlet opening 72.

Figure 3:
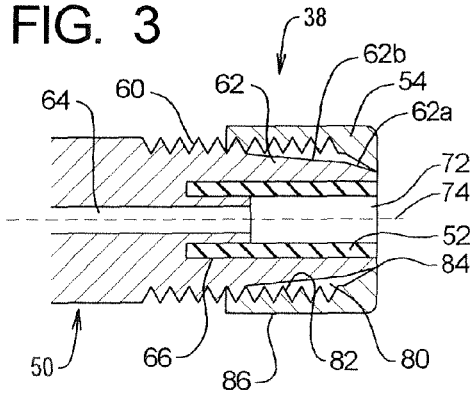
FIG. 3 is a section view of the first example outlet assembly in a first configuration.
Figure 4:
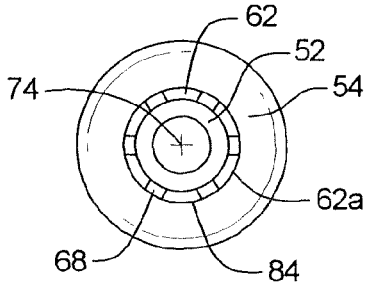
FIG. 4 is an end elevation view of the first example outlet assembly in the first configuration.
Figure 5:
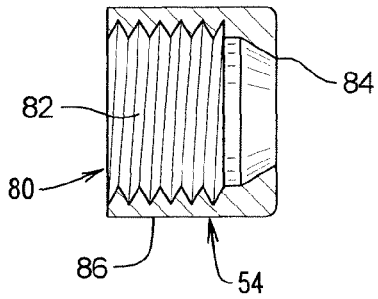
FIG. 5 is a section view of a collar member of the first example outlet assembly.
Figure 6:
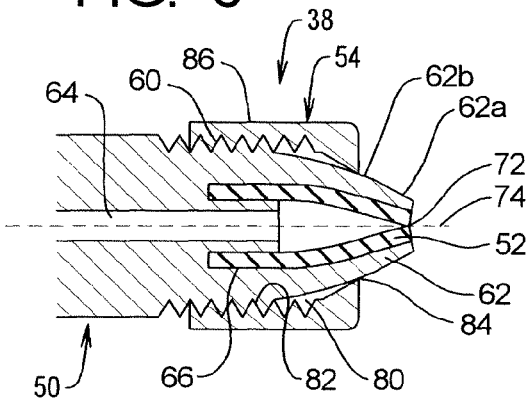
FIG. 6 is a section view of the first example outlet assembly in a second configuration.
Figure 7:
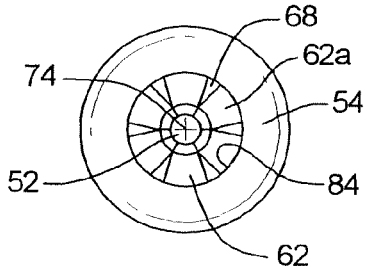
FIG. 7 is an end elevation view of the first example outlet assembly in the second configuration.

The altering of the cross-sectional area of the outlet opening 72 is shown by a comparison of FIGS. 3 and 4, where the outlet opening 72 is at its maximum cross-sectional area, and FIGS. 6 and 7, where the outlet opening 72 is at its minimum cross-sectional area. The cross-sectional area may be at any one of a continuum of values between the maximum and minimum positions.

The collar member 54 is thus rotated relative to the outlet member 50 such that the cross-sectional area of the outlet opening 72 is set at a value at which the texture material is dispensed in a desired texture pattern that substantially matches an existing texture pattern of the existing surface coating 28.

Figure 8:
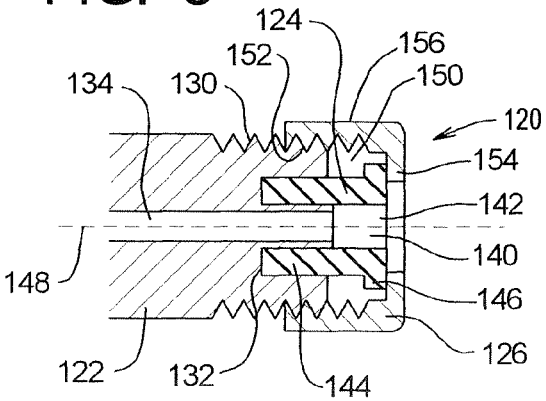
FIG. 8 is a section view of a second example outlet assembly in a first configuration.
Figure 9:
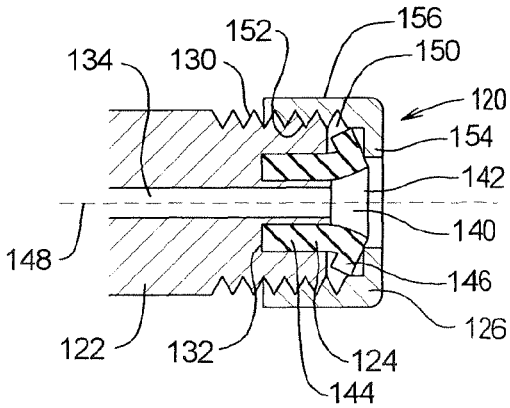
FIG. 9 is a section view of the second example outlet assembly in a second configuration.

Turning now to FIGS. 8 and 9 of the drawing, depicted therein is a second example outlet assembly 120 that may be used as part of a dispensing system of the present invention. The outlet assembly 120 comprises an outlet member 122, a resilient member 124, and a collar member 126. The second example outlet assembly 120 may be secured relative to, rigidly connected to, or integrally formed with the pump housing 40; the example outlet member 122 is integrally formed with the pump housing 40.

The outlet member 122 defines a first threaded portion 130, a socket portion 132, and a dispensing passageway 134 along which the liquid texture material 30*a* is forced out of the bottle assembly 32.

The example resilient member 124 defines an outlet passageway 140 and an outlet opening 142. The example resilient member comprises a base portion 144 and a flange portion 146. The base portion 144 is sized and dimensioned to secure the resilient member 124 within the dispensing passageway 134. The outlet passageway 140 defines a dispensing axis 148 along which texture material passes as the texture material is forced out of the bottle assembly 32.

The collar member 126 defines a collar passageway 150, a second threaded portion 152, retaining portion 154, and a grip surface 156. The collar member 126 is displaced relative to the outlet member 122 such that resilient member 124 enters the collar passageway 150. Continued displacement of the collar member 126 causes the first and second threaded portions 130 and 152 to touch each other. At that point, the grip surface 156 may be gripped to rotate the collar member 126 relative to the outlet member 122 to cause the threaded portions 130 and 152 to engage each other such that the collar member 126 moves along the dispensing axis 148 relative to the outlet member 122.

As the collar member 126 moves along the dispensing axis 148 relative to the outlet member 122, the retaining portion 154 of the collar member 126 engages the flange portion 146 of the resilient member 124. Continued rotation of the collar member 126 relative to the outlet member 122 causes the retaining portion 154 to engage the flange portion 146 to deform the resilient member and thereby alter a cross-sectional area of the outlet opening 142.

The altering of the cross-sectional area of the outlet opening 142 is shown by a comparison of FIG. 9, where the outlet opening 142 is at its maximum cross-sectional area, and FIG. 8, where the outlet opening 142 is at its minimum cross-sectional area. The cross-sectional area may be at any one of a continuum of values between the maximum and minimum positions.

The collar member 126 is thus rotated relative to the outlet member 122 such that the cross-sectional area of the outlet opening 142 is set at a value at which the texture material is dispensed in a desired texture pattern that substantially matches an existing texture pattern of the existing surface coating 28.

Figure 10:
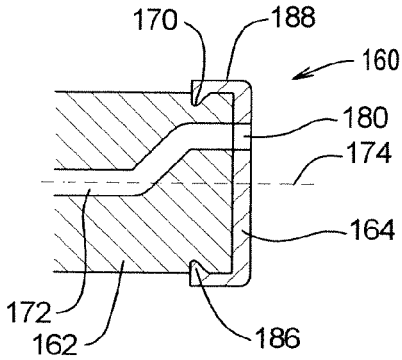
FIG. 10 is a section view of a third example outlet assembly.
Figure 11:
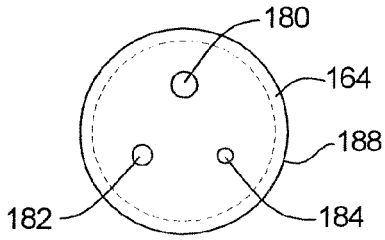
FIG. 11 is an end elevation view of the third example outlet assembly.

Referring now to FIGS. 10 and 11 of the drawing, depicted therein is a third example outlet assembly 160 that may be used as part of a dispensing system of the present invention. The outlet assembly 160 comprises an outlet member 162 and a collar member 164. The third example outlet assembly 160 may be secured relative to, rigidly connected to, or integrally formed with the pump housing 40; the example outlet member 162 is integrally formed with the pump housing 40.

The outlet member 162 defines a mounting groove 170 and a dispensing passageway 172. The dispensing passageway is offset from a longitudinal axis 174 of the outlet member 162. The collar member 164 defines a first collar opening 180, a second collar opening 182, a third collar opening 184, a mounting projection 186, and a grip surface 188. The collar member 164 receives a portion of the outlet member 162 such that the mounting groove 170 receives the mounting projection 186.

With the mounting projection 186 in the mounting groove 170, the collar member 164 is held against inadvertent movement along the longitudinal axis 174 but can rotate about the longitudinal axis 174. In this configuration, any one of the collar openings 180, 182, and 184 can be aligned with the dispensing passageway.

The collar openings 180, 182, and 184 each define a different cross-sectional area. Accordingly, arranging a selected one of the collar openings 180, 182, or 184 such that fluid flowing along the dispensing passageway 172 last flows out of the selected collar opening 180, 182, or 184. The collar member 164 is thus rotated relative to the outlet member 162 such that the cross-sectional area of the selected collar openings 180, 182, and 184 determines a desired texture pattern in which deposited on the target surface 22 such that the desired texture pattern substantially matches an existing texture pattern of the existing surface coating 28.

Figure 12:
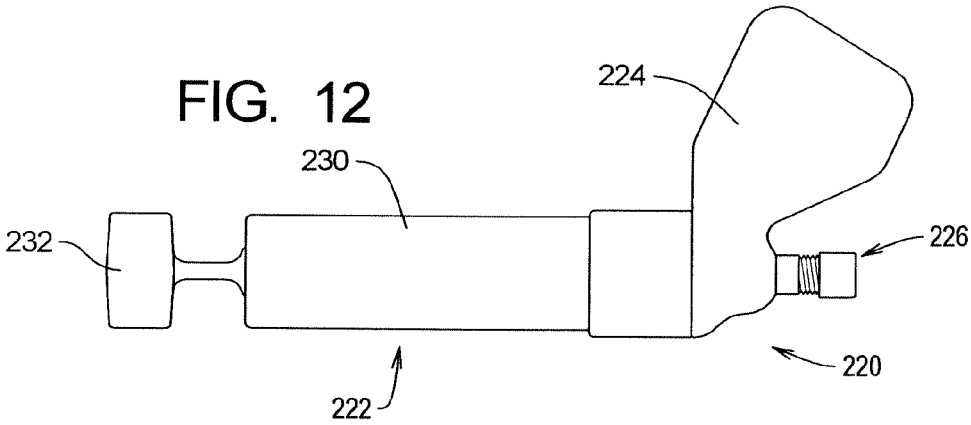
FIG. 12 is a side elevation view of a second example hand-operated dispensing system of the present invention.

Referring now to FIG. 12 of the drawing, depicted therein is a second example dispensing system 220 constructed in accordance with, and embodying, the principles of the present invention. The second example dispensing system 220 comprises a pump assembly 222, a hopper 224, and an outlet assembly 226. The pump assembly 222 comprises a pump housing 230 and a piston member 232.

The outlet assembly 226 may be any one of the first, second, or third example outlet assemblies 38, 120, or 160 described above. In any case, the outlet assembly may be secured relative to, rigidly connected to, or integrally formed with the pump housing 230. The example outlet assembly 226 is illustrated as either the first example outlet assembly 38 or the second example outlet assembly 120, and the outlet member 50 or 122 of either of these assemblies 38 or 120 is integrally formed with the pump housing 230.

Texture material is held in liquid form 30*a* in the hopper 224. The hopper 224 is connected to the pump housing 230 such that texture material flows into a mixing chamber (not shown) defined by the pump housing 230. Displacing the piston member 232 relative to the pump housing 230 forces air through the mixing chamber, thereby entraining texture material within the mixing chamber such that the stream of air carries the texture material out of to the pump housing 230 in a spray that is deposited onto the target surface 22. Again, the outlet assembly 226 may be configured to define the cross-sectional area of an outlet opening defined thereby and thereby deposit texture material in a desired texture pattern that substantially matches the existing texture pattern.

Figure 13:
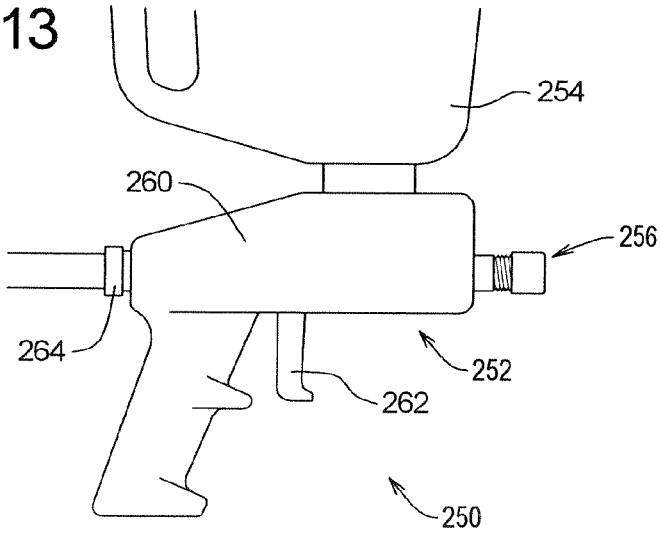
FIG. 13 is a side elevation view of a third example hand-operated dispensing system of the present invention.

Referring now to FIG. 13 of the drawing, depicted therein is a third example dispensing system 250 constructed in accordance with, and embodying, the principles of the present invention. The third example dispensing system 250 comprises a spray gun assembly 252, a hopper 254, and an outlet assembly 256. The spray gun assembly 252 comprises a gun housing 260, a trigger member 262, and an air inlet 264.

The outlet assembly 256 may be any one of the first, second, or third example outlet assemblies 38, 120, or 160 described above. In any case, the outlet assembly may be secured relative to, rigidly connected to, or integrally formed with the gun housing 260. The example outlet assembly 256 is illustrated as either the first example outlet assembly 38 or the second example outlet assembly 120, and the outlet member 50 or 122 of either of these assemblies 38 or 120 is integrally formed with the gun housing 260.

Texture material is held in liquid form 30*a* in the hopper 254. The hopper 254 is connected to the gun housing 260 such that texture material flows into a mixing chamber (not shown) defined by the gun housing 260. Pressurized air introduce into the gun housing 260 through the air inlet 264 forces air through the mixing chamber, thereby entraining texture material within the mixing chamber such that the stream of air carries the texture material out of the gun housing 260 in a spray that is deposited onto the target surface 22. Again, the outlet assembly 256 may be configured to define the cross-sectional area of an outlet opening defined thereby and thereby deposit texture material in a desired texture pattern that substantially matches the existing texture pattern.

The texture material 30 may be conventional, and one example of a texture material to be dispensed using the dispensing systems described herein is described in the following table.

GENERAL EXAMPLE OF TEXTURE MATERIAL CONCENTRATE

| COMPONENT | FIRST PREFERRED RANGE | SECOND PREFERRED RANGE |
|---|---|---|
| solvent/carrier | 30-60% | 25-65% |
| fillers | 40-60% | 20-70% |
| resin/binder | 4.5-5.5% | 3-7% |
| additives | 0.250-0.750% | 0.000-1.000% |

The example texture material 30 will most likely be water based, and the solvent/carrier component forms the base. In a water based texture material, the solvent/carrier component will be water or a combination of water and a water soluble solvent such as tetrahydrofuran, acetone, methanol, iso-propanol, ethanol, N-propanol, propylene glycol monomethyl-ether, propylene glycol n-propyl ether, diethylene glycol monomethyl ether, diacetone alchohol, ethylene glycol monobutyl ether, N-methyl pyrrolidone, dipropylene glycol methyl ether, diethanolamine, diethylene glycol monethyl ether, diethylene glycol, methyl ethyl ketone, and methyl acetate.

The filler component typically comprises clay, talc, calcium carbonate, pigments, and other materials that add body, color, and the like to the dry coating 30*c*. The filler component may also comprise one or more thickener materials. Ideally, the texture material 30 is formulated such that it is sufficiently thick to hold its shape when initially applied to the target surface to 22 in the liquid form 30*a* but which is thin enough to be dispensed in an acceptable spray pattern in the spray form 30*b* using a spray pump assembly such as the spray pump assembly 36.

One example thickener that meets these requirements is a thickener available from Rohm and Haas under the tradename Accusol 820. The filler component thus may incorporate a thickener such as the Accusol 820 product or its equivalent. One example of a texture material incorporating the Accusol 820 thickener product includes approximately 3.3% by weight of that ingredient. The exact amount of Accusol 820 will depend upon a particular formulation and purpose of the texture material but is typically within a first preferred range of substantially between 2.3% and 4.3% by weight and in any event should be within a second preferred range of substantially between 2% and 10% by weight.

The resin binder component is typically a latex material such as is commonly used in coating materials such as texture material or paint. The additives may be biocides, defoamers, dispersants, and the like.

The present invention may be embodied in forms other than those described above. The scope of the present invention should thus be determined by the scope of the claims appended hereto and not the foregoing detailed description of the invention.

What is claimed is:

1. A system for coating a target surface in a desired texture pattern that substantially matches a preexisting texture pattern on the target surface, comprising:
- texture material;
- a bottle for containing the texture material;
- a spray pump assembly comprising
  - a pump housing operatively connected to the bottle, where the pump housing comprises a plurality of fingers,
  - a dip tube extending from the pump housing to the texture material within the bottle, and
  - an actuator member;
- a resilient member supported by the plurality of fingers to define an outlet opening; and
- a collar member supported by the pump housing such that the collar member is movable relative to the resilient member; whereby
- moving the collar member relative to the resilient member such that the collar member indirectly acts on the resilient member through the fingers to deform the resilient member to alter a cross-sectional area of the outlet opening such that the cross-sectional area of the outlet opening is associated with the desired spray pattern; and
- displacing the actuator member forces the texture material through the dip tube, out of the bottle member, through the outlet opening, and onto the target surface such that the texture material dries to form a coating in the desired texture pattern.

2. A system as recited in claim 1, in which the spray assembly is the actuator member that is displaced by hand.

3. A system as recited in claim 1, in which the resilient member defines a flange portion, where the collar member acts on the flange to alter the cross-sectional area of the outlet opening.

4. A system as recited in claim 1, in which the texture material comprises:
- a carrier;
- filler material; and
- a binder.

5. A system as recited in claim 4, in which the carrier comprises a solvent.

6. A system as recited in claim 5, in which the carrier further comprises water soluble solvent.

7. A system as recited in claim 4, in which the binder comprises a latex material.

8. A system as recited in claim 4, in which the filler material comprises a thickener.

9. A method of coating a target surface in a desired texture pattern that substantially matches a preexisting texture pattern on the target surface, comprising:
- arranging texture material within a bottle;
- providing a spray pump assembly comprising a pump housing, a dip tube, and an actuator member;
- forming deformable fingers on the pump housing;
- operatively connecting the spray pump assembly to the bottle such that the dip tube extends into the texture material;
- supporting a resilient member relative to the bottle using the plurality of fingers, where the resilient member defines an outlet opening;
- supporting a collar member such that the collar member is movable relative to the resilient member;
- displacing the collar member relative to the pump housing such that the collar member indirectly acts the resilient member through the fingers to deform the resilient member to alter a cross-sectional area of the outlet opening such that the cross-sectional area of the outlet opening is associated with a spray pattern associated with the desired texture pattern; and displacing the actuator member to cause pressurized air to flow through the spray pump assembly such that the pressurized air forces the texture material through the dip tube, out of the bottle member, through the outlet opening, and onto the target surface such that the texture material dries to form a coating in the desired texture pattern.

10. A method as recited in claim 9, in which the actuator member is displaced by hand.

11. A method as recited in claim 9, in which:

the step of providing the resilient member comprises the step of forming a flange portion on the resilient member; and the step of moving the collar member comprises the step of causing the collar member to engage the flange to alter the cross-sectional area of the outlet opening.

* * * * *